US010164379B2

(12) United States Patent
Duan et al.

(10) Patent No.: US 10,164,379 B2
(45) Date of Patent: Dec. 25, 2018

(54) ELECTRICAL RECEPTACLE CONNECTOR WITH IMPROVED DURABILITY AND SHIELDING PERFORMANCE

(71) Applicant: ADVANCED-CONNECTEK INC., New Taipei (TW)

(72) Inventors: Shu-Lin Duan, New Taipei (TW); Wei Wan, New Taipei (TW); Fu-Yi Xu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/270,431

(22) Filed: Sep. 20, 2016

(65) Prior Publication Data

US 2017/0085038 A1 Mar. 23, 2017

(30) Foreign Application Priority Data

Sep. 21, 2015 (CN) ..... 2015 1 0599513

(51) Int. Cl.

| | |
|---|---|
| ***H01R 13/6581*** | (2011.01) |
| ***H01R 13/6585*** | (2011.01) |
| ***H01R 13/6594*** | (2011.01) |
| ***H01R 24/60*** | (2011.01) |
| *H01R 107/00* | (2006.01) |
| *H01R 13/658* | (2011.01) |
| *H01R 24/64* | (2011.01) |
| *H01R 13/648* | (2006.01) |

(52) U.S. Cl.

CPC ..... *H01R 13/6585* (2013.01); *H01R 13/6594* (2013.01); *H01R 24/60* (2013.01); *H01R 13/648* (2013.01); *H01R 13/658* (2013.01); *H01R 13/6581* (2013.01); *H01R 24/64* (2013.01); *H01R 2107/00* (2013.01)

(58) Field of Classification Search

CPC ..... H01R 13/648; H01R 13/6581; H01R 13/658; H01R 24/64

USPC ..... 439/607.01, 607.05, 676

See application file for complete search history.

(56) References Cited

U.S. PATENT DOCUMENTS

| | | | | |
|---|---|---|---|---|
| 9,865,974 | B2 * | 1/2018 | Chen | H01R 24/62 |
| 2016/0134059 | A1 * | 5/2016 | Deng | H01R 13/6581 439/607.01 |
| 2016/0149350 | A1 * | 5/2016 | Kao | H01R 12/724 439/607.05 |

(Continued)

*Primary Examiner* — Abdullah Riyami
*Assistant Examiner* — Justin Kratt
(74) *Attorney, Agent, or Firm* — Muncy, Geissler, Olds & Lowe, P.C.

(57) ABSTRACT

An electrical receptacle connector includes a mount member, an insulated housing, first receptacle terminals, second receptacle terminals, and a shielding plate. The insulated housing is molded with the mount member and forms a tongue portion. Each of the first receptacle terminals includes a first flat contact portion and a first tail portion. The first flat contact portion is on a lower surface of the tongue portion, and front ends of the first flat contact portions are held in the tongue portion. Each of the second receptacle terminals includes a second flat contact portion and a second tail portion. The second flat contact portions are on an upper surface of the tongue portion, and front ends of the second flat contact portions are held in the tongue portion. The shielding plate is on the tongue portion and between the first receptacle terminals and the second receptacle terminals.

21 Claims, 11 Drawing Sheets

(56) References Cited

U.S. PATENT DOCUMENTS

| | | | | |
|---|---|---|---|---|
| 2016/0197443 | A1* | 7/2016 | Zhang | H01R 13/6585<br>439/607.05 |
| 2016/0380389 | A1* | 12/2016 | Ju | H01R 13/6585<br>439/607.05 |

* cited by examiner

1

| | | | | | | | | | | | |
|---|---|---|---|---|---|---|---|---|---|---|---|
| GND | TX1+ | TX1− | VBUS | CC1 | D+ | D− | SBU1 | VBUS | RX2− | RX2+ | GND |
| GND | RX1+ | RX1− | VBUS | SBU2 | D− | D+ | CC2 | VBUS | TX2− | TX2+ | GND |

Fig. 10

ELECTRICAL RECEPTACLE CONNECTOR WITH IMPROVED DURABILITY AND SHIELDING PERFORMANCE

CROSS-REFERENCES TO RELATED APPLICATIONS

This non-provisional application claims priority under 35 U.S.C. § 119(a) on Patent Application No. 201510599513.3 filed in China, P.R.C. on 2015 Sep. 21, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, populations of faster serial bus interfaces such as USB 3.1, increase gradually, which may provide a higher transmission rate, e.g., up to 10 Gbs, so as to satisfy the need of a variety devices.

For a conventional USB connector, a plastic core (insulated housing) having a tongue portion is formed firstly followed by inserting terminals into the insulated housing. Alternatively, the terminals may be molded with the insulated housing by an insert-molding procedure. An outer shell encloses the insulated housing. The outer shell is provided for, mainly, shielding the electromagnetic waves generated by the terminals to prevent from noise interferences.

However, the front ends of the terminals of the conventional connector may be detached from the insulated housing easily because the connector is used improperly or when the connector is used for a long period. As a result, the connector may be damaged. Upon a connector is damaged, not only the motherboard has to be detached from the connector for replacement, but also the connector itself has to be replaced. Therefore, the cost for the repair of the connector is expensive.

In addition, a USB 3.1 connector can transmit a speed up to 10 Gbs. Therefore, it can be applied as the interface of a high frequency, a radiofrequency, a wireless, or a Bluetooth emitter. When only the outer shell is provided for shielding the electromagnetic waves, the shielding performance may be reduced because the gaps formed on the outer shell. As a result, when the connector is adapted for high frequency, radiofrequency, wireless, or Bluetooth signal transmission, the quality of the signals is undesirable.

SUMMARY OF THE INVENTION

Therefore, how to improve the plug-and-unplug durability of the connector as well as the shielding performance, how to reduce electromagnetic interference (EMI) and radiofrequency interference (RFI), and how to improve the efficacy and the life time of the product are issues.

In view of this, an embodiment of the instant disclosure provides an electrical receptacle connector. The electrical receptacle connector comprises a mount member, an insulated housing, a plurality of first receptacle terminals, a plurality of second receptacle terminals, and a shielding plate. The insulated housing is molded with the mount member and comprises a tongue portion extending along a direction. The first receptacle terminals are on the mount member and the insulated housing. Each of the first receptacle terminals comprises a first flat contact portion, a first body portion, and a first tail portion. The first body portions are held in the mount member. Each of the first flat contact portions is extending forward from the corresponding first body portion in the rear-to-front direction and protruding from the mount member, and each of the first tail portions is extending backward from the corresponding first body portion in the front-to-rear direction. The first flat contact portion is on a lower surface of the tongue portion, and front ends of the first flat contact portions are held in the tongue portion. The first tail portions are protruding from the mount member. The second receptacle terminals are on the mount member and the insulated housing. Each of the second receptacle terminals comprises a second flat contact portion, a second body portion, and a second tail portion. Each of the second flat contact portions is extending forward from the corresponding second body portion in the rear-to-front direction, and each of the second tail portions is extending backward from the corresponding second body portion in the front-to-rear direction. The second flat contact portions are on an upper surface of the tongue portion, and front ends of the second flat contact portions are held in the tongue portion. The second tail portions are protruding from the insulated housing. The shielding plate is on the tongue portion and between the first receptacle terminals and the second receptacle terminals.

In one embodiment, the electrical receptacle connector further comprises a first conductive sheet and a second conductive sheet. The first conductive sheet and the second conductive sheet are above and below the insulated housing, respectively, for shielding the first receptacle terminals from the second receptacle terminals. Moreover, the first conductive sheet has two first contact legs at two sides thereof. The two first contact legs pass through two first through holes of the insulated housing and are in contact with two first ground terminals which are at two sides of the first receptacle terminals, respectively. In addition, the second conductive sheet has two second contact legs at two sides thereof. The two second contact legs pass through two second through holes of the insulated housing and are in contact with two second ground terminals which are at two sides of the second receptacle terminals, respectively. Accordingly, a grounding circuit is established and the shielding performance of the connector can be improved to prevent from electromagnetic interference.

In one embodiment, the electrical receptacle connector further comprises an inner shell assembled to the outside of the insulated housing and the mount member and being in contact with the first conductive sheet and the second conductive sheet. Moreover, the shielding plate further has two connecting members at two sides thereof. The two connecting members are extending from two sides of the mount member and in contact with the inner shell. The two connecting members are between the mount member and the insulated housing. Additionally, the mount member comprises a supporting portion and two holding portions at two sides of the supporting portion. The shielding plate is engaged onto the holding portions and positioned with the mount member. The connecting members are on the respective holding portions. The insulated housing is assembled with the supporting portion and the holding portions, and the tongue portion is positioned between the holding portions.

Moreover, the electrical receptacle connector further comprises an outer shell assembled to the outside of the inner shell and in contact with the inner shell. Accordingly, a grounding circuit can be established to improve the shielding performance.

In one embodiment, the mount member and the first receptacle terminals are pre-molded to form a terminal module. Moreover, the shielding plate and the second receptacle terminals are pre-molded, assembled with the terminal module, and enclosed by the insulated housing.

In one embodiment, an upper surface and a lower surface of the shielding plate are processed with an insulating treatment. The shielding plate is above the mount member and the first receptacle terminals and below the second receptacle terminals. Moreover, the upper surface and the lower surface of the shielding plate comprise a plurality of protruding ribs. The protruding ribs respectively form a plurality of channels on the upper surface and the lower surface of the shielding plate. The first receptacle terminals and the second receptacle terminals are respectively positioned in the channels on the upper surface and the lower surface of the shielding plate.

In one embodiment, the shielding plate comprises a flat portion and an end portion extending from the flat portion. The end portion partially shields the first tail portions from the second tail portions.

In one embodiment, each of the first tail portions is bent at an angle relative to the corresponding first flat contact portion. In another embodiment, each of the second tail portions is bent at an angle relative to the corresponding second flat contact portion.

In one embodiment, the front end of each of the first flat contact portions comprises a first engaging portion held in the tongue portion. In another embodiment, the front end of each of the second flat contact portions comprises a second engaging portion held in the tongue portion.

Another embodiment of the electrical receptacle connector comprises a mount member, an insulated housing, a plurality of first receptacle terminals, a plurality of second receptacle terminals, and a shielding plate. The mount member is integrally formed with the first receptacle terminals. Each of the first receptacle terminals comprises a first flat contact portion, a first body portion, and a first tail portion. The first body portions are held in the mount member. Each of the first flat contact portions is extending forward from the corresponding first body portion in the rear-to-front direction and protruding from the mount member, and each of the first tail portions is extending backward from the corresponding first body portion in the front-to-rear direction. The shielding plate is on the mount member and above the first receptacle terminals. The second receptacle terminals are above the shielding plate, so that the shielding plate is between the first receptacle terminals and the second receptacle terminals. Each of the second receptacle terminals comprises a second flat contact portion, a second body portion, and a second tail portion. Each of the second flat contact portions is extending forward from the corresponding second body portion in the rear-to-front direction, and each of the second tail portions is extending backward from the corresponding second body portion in the front-to-rear direction. The insulated housing comprises a base portion and a tongue portion extending from one end of the base portion. The base portion and the mount member are pre-molded. The tongue portion is integrally formed with and covering the first receptacle terminals, the shielding plate, and the second receptacle terminals. The first flat contact portions are on a lower surface of the tongue portion, and front ends of the first flat contact portions are held in the tongue portion. The second flat contact portions are on an upper surface of the tongue portion, and front ends of the second flat contact portions are held in the tongue portion.

Accordingly, the front portions of the terminals are fixed during the terminals are insert-molded with the insulated housing. Therefore, during the connector is mated with a mating connector, the terminals can be firmly positioned on the tongue portion to prevent from being damaged by the mating connector. Furthermore, the terminals are designed in a simple way without several bending portions. Moreover, the shielding plate can be provided for establishing a grounding circuit, improving the shielding effect. Therefore, the efficacy of the connector in high frequency signal transmission can be improved.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 10 illustrates a schematic configuration diagram of the receptacle terminals of the electrical receptacle connector.

DETAILED DESCRIPTION

Figure 1:
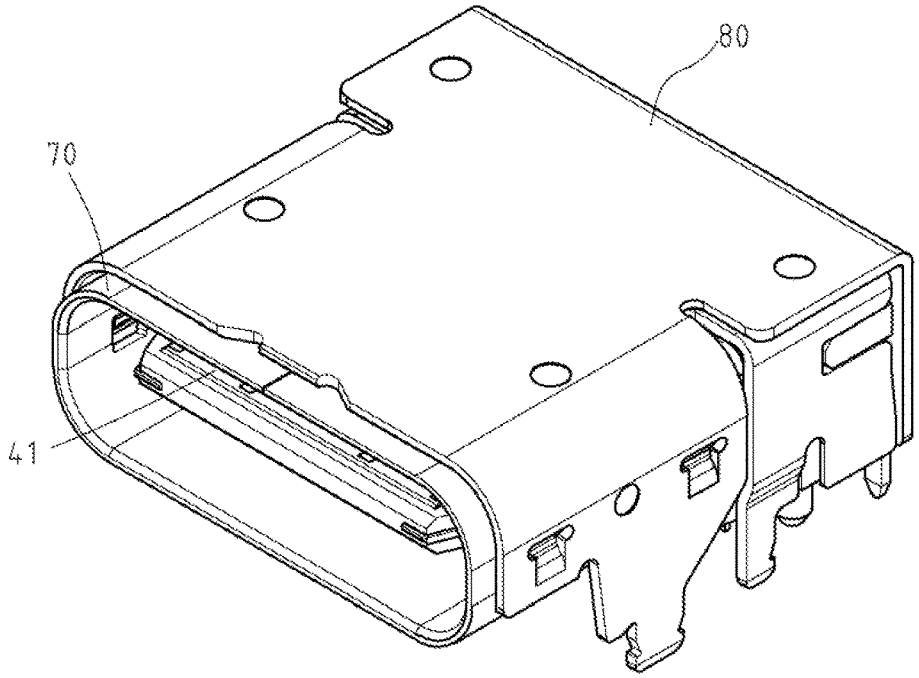
FIG. 1 illustrates a perspective view of an electrical receptacle connector according to an exemplary embodiment of the instant disclosure.
Figure 2:
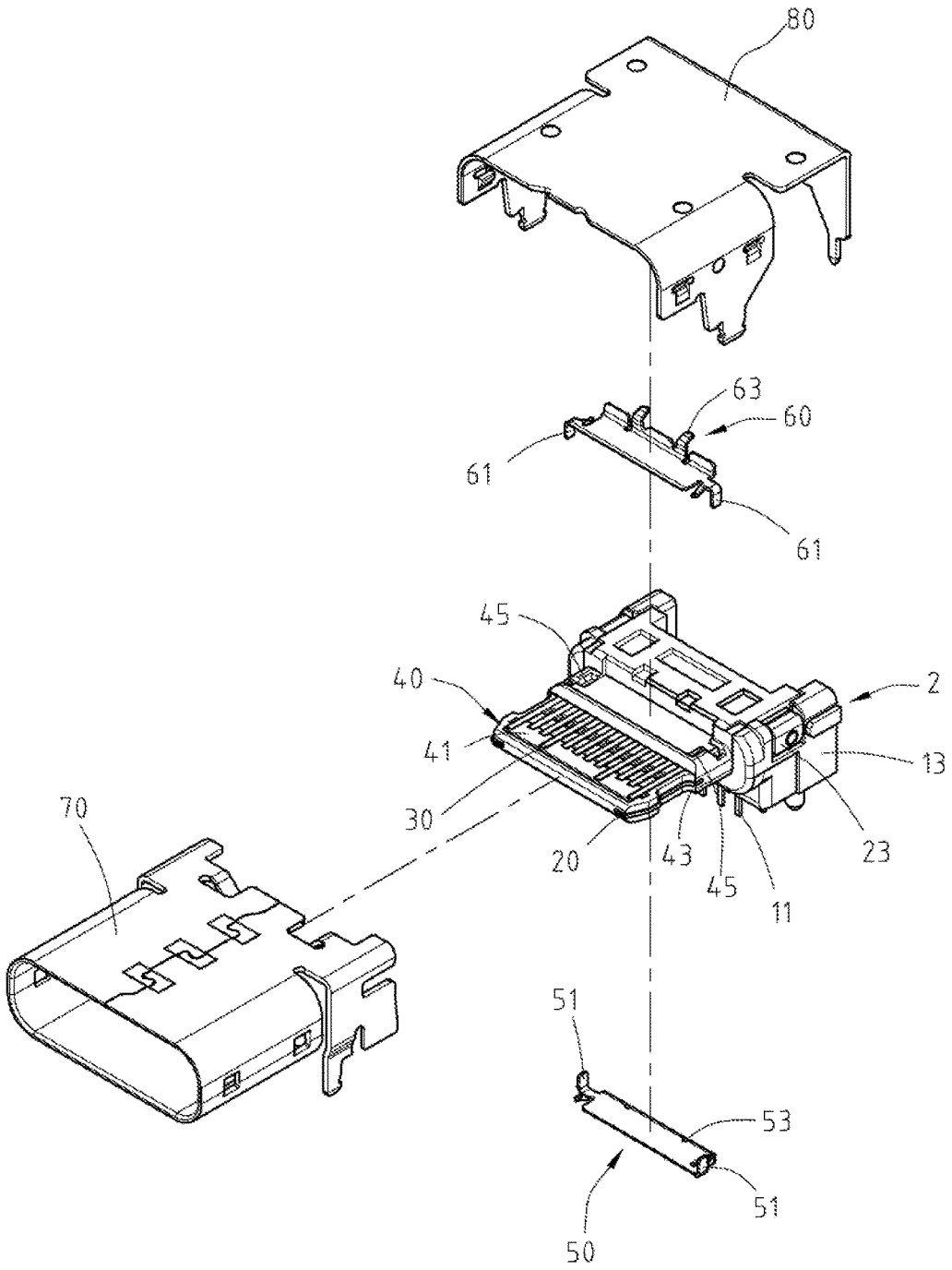
FIG. 2 illustrates an exploded view of the electrical receptacle connector.
Figure 3A:
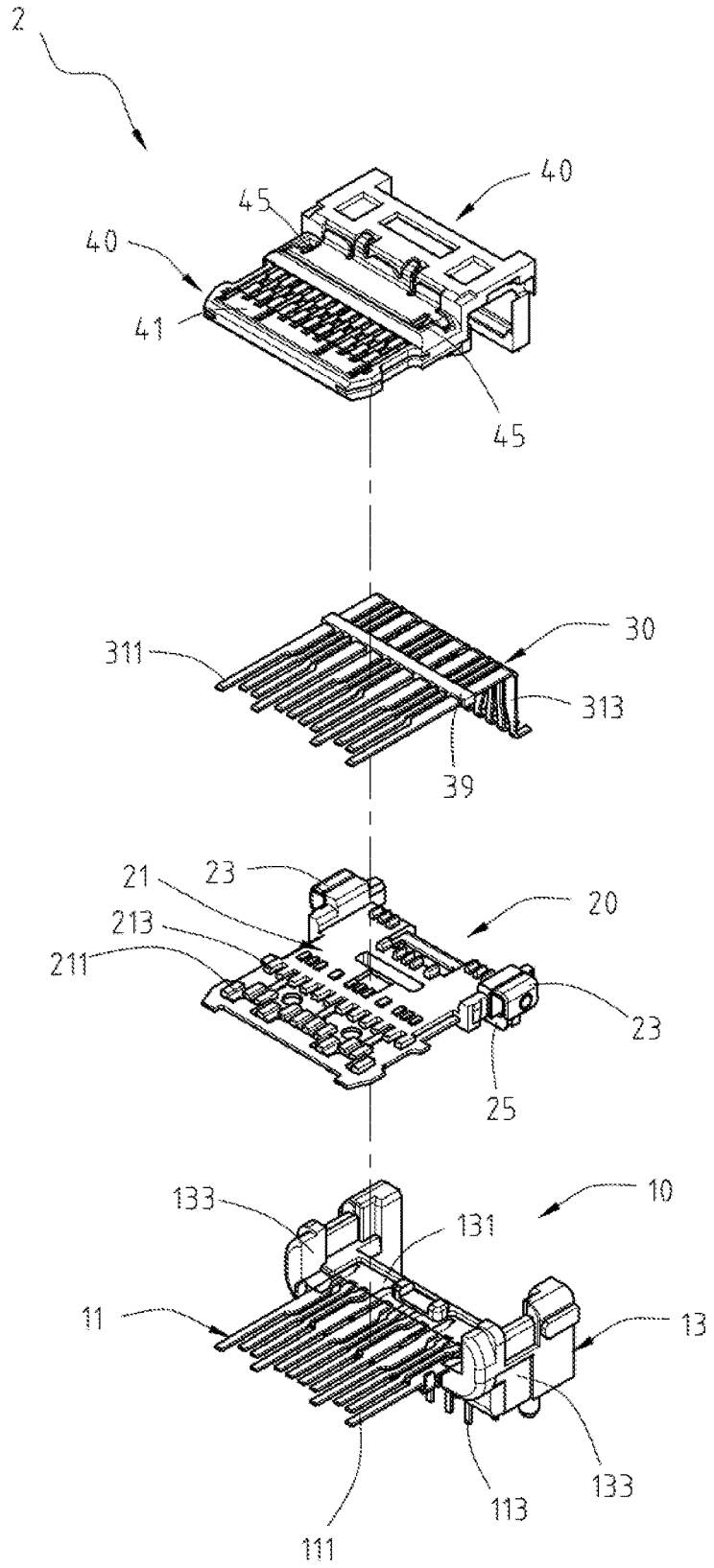
FIG. 3*a* illustrates a detailed exploded view of the electrical receptacle connector.
Figure 3B:
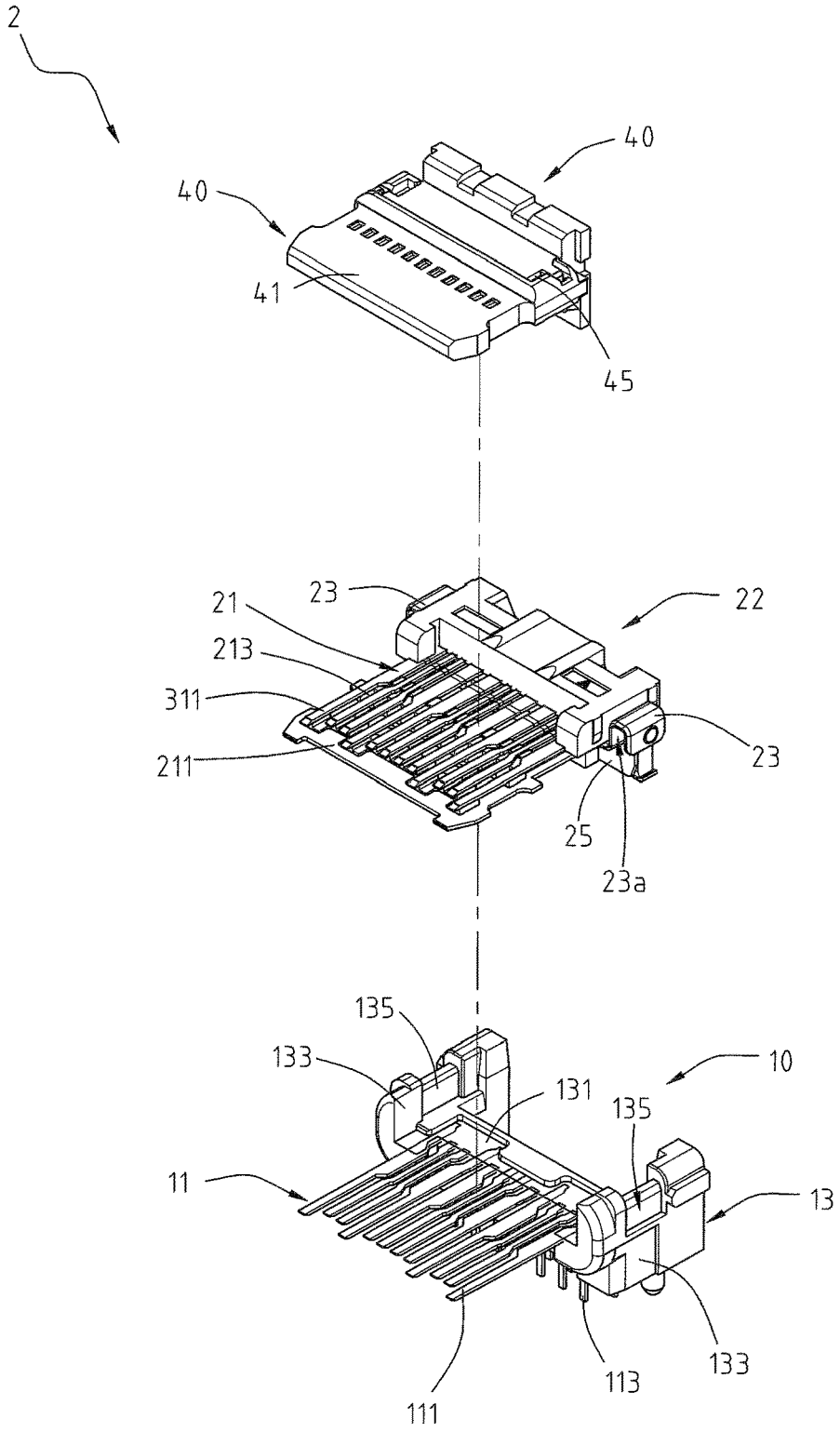
FIG. 3*b* illustrates a detailed exploded view of another embodiment of the electrical receptacle connector.
Figure 4:
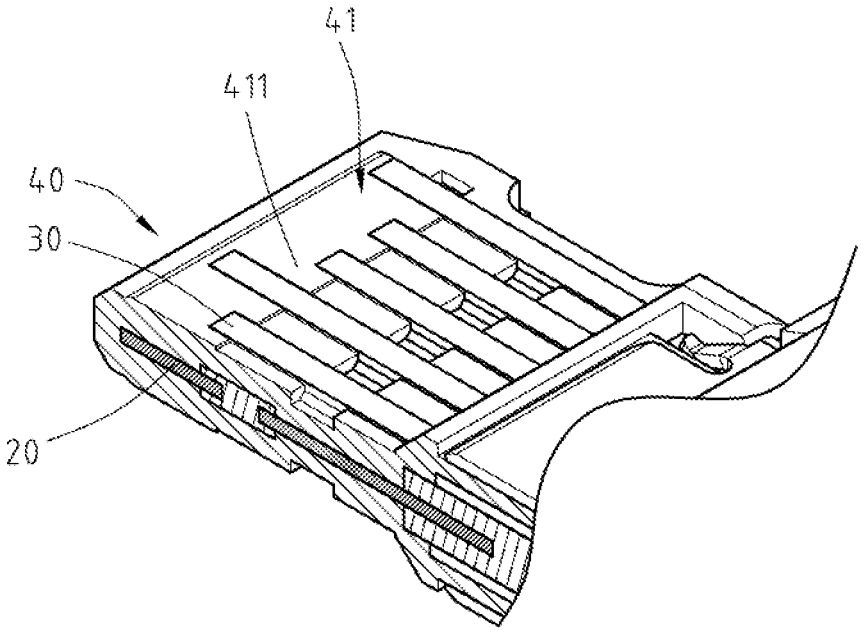
FIG. 4 illustrates a partial exploded view of the electrical receptacle connector.

Please refer to FIGS. 1, 2, 3*a*, 3*b*, and 4, illustrating an electrical receptacle connector of an exemplary embodiment of the instant disclosure. FIG. 1 illustrates a perspective view of an electrical receptacle connector according to an exemplary embodiment of the instant disclosure. FIG. 2 illustrates an exploded view of the electrical receptacle connector. FIG. 3*a* illustrates a detailed exploded view of the electrical receptacle connector. FIG. 3*b* illustrates a detailed exploded view of another embodiment of the electrical receptacle connector. FIG. 4 illustrates a partial exploded view of the electrical receptacle connector. As shown in FIGS. 1 to 4, the electrical receptacle connector 1 comprises a plurality of first receptacle terminals 11, a mount member 13, a shielding plate 20, a plurality of second receptacle terminals 30, and an insulated housing 40. The first receptacle terminals 11 and the mount member 13 can form a terminal module 10 by insert-molding procedures in advance, so that the first receptacle terminals 11 are fixedly positioned in the mount member 13. And then, the terminal module 10 is assembled with the shielding plate 20 and the second receptacle terminals 30. Next, an insulated housing 40 is enclosing the terminal module 10, the shielding plate 20, and the second receptacle terminals 30 by insert-molding procedures. The assembly of the insulated housing 40, the terminal module 10, the shielding plate 20, and the second receptacle terminals 30 are formed as an inserting module 2. During the insert-molding procedure, the insulated housing 40 forms a tongue portion 41 for fixing with the first receptacle terminals 11 and the second receptacle terminals 30. Here, during the insert-molding procedures, portions of a component (e.g., the terminal) are enclosed and positioned with a plastic material.

In one embodiment, each of the first receptacle terminals 11 comprises a flat contact portion 111 and a tail portion 113 extending from one end of the flat contact portion 111. In detail, each of the first receptacle terminals 11 comprises a flat contact portion 111, a body portion, and a tail portion 113. The body portions are held in the mount member 13, each of the flat contact portions 111 is extending forward from the corresponding body portion in the rear-to-front direction and protruding from the mount member 13, and each of the tail portions 113 is extending backward from the corresponding body portion in the front-to-rear direction. Each of the tail portions 113 is bent at an angle relative to the corresponding flat contact portion 111; for example, the tail portion 113 may be vertical to the flat contact portion 111.

The mount member 13 comprises a supporting portion 131 and two holding portions 133. The flat contact portion 111 of each of the first receptacle terminals 11 is partially held in the supporting portion 131 and extending in a first direction. Similarly, the tail portion 113 of each of the first receptacle terminals 11 is partially held in the supporting portion 131 and protruding from the supporting portion 131 in a second direction. The angle between the first direction and the second direction is equal to the angle between the flat contact portion 111 and the tail portion 113. The two holding portions 133 are at two sides of the supporting portion 131, and the first receptacle terminals 11 are positioned between the two holding portions 133. After the insert-molding procedures, the tongue portion 41 is positioned between the holding portions 133.

The shielding plate 20 is between the first receptacle terminals 11 and the second receptacle terminals 30 for preventing from the crosstalk between terminals. The inner layer of the shielding plate 20 is a metallic plate. To prevent from getting short circuit, an upper surface and a lower surface of the shielding plate 20 are processed with an insulating treatment. The shielding plate 20 comprises a flat portion 21. A plurality of protruding ribs 211 is formed on an upper surface of the flat portion 21 and a lower surface of the flat portion 21 respectively to define a plurality of channels 213. The channels 213 are for positioning the first receptacle terminals 11 and the second receptacle terminals 30. The shielding plate 20 is engaged and positioned with the two holding portions 133. The shielding plate 20 further comprises two connecting members 23 at two sides thereof. The connecting members 23 are extending upwardly and outwardly from two sides of the flat portion 21. Each of the connecting members 23 has a horizontal height which is higher than the flat portion 21. The two connecting members 23 are respectively protruding from the two holding portions 133. The connecting members 23 are conductive and are not processed by the insulating treatment. Moreover, the mount member 133 has two positioning grooves 135 concaved from the holding portions 133. The two connecting members 23 are positioned at the positioning grooves 135. Please refer to FIGS. 3*a* and 3*b*. Each of the connecting members 23 has a receiving cavity 23*a* facing downwardly for engaging with the corresponding holding portion 133 of the mount member 13. Moreover, two ends of each of the connecting members 23 are abutted against two outer peripheries of the corresponding positioning groove 135, respectively.

The second receptacle terminals 30 are above the shielding plate 20 and positioned between the two holding portions 133. The second receptacle terminals 30 are positioned by the protruding ribs 211. Each of the second receptacle terminals 30 comprises a flat contact portion 311 and a tail portion 313 extending from one end of the flat contact portion 311. In detail, each of the second receptacle terminals 30 comprises a flat contact portion 311, a body portion, and a tail portion 313. Each of the flat contact portions 311 is extending forward form from the corresponding body portion in the rear-to-front direction, and each of the tail portions 313 is extending backward from the corresponding body portion in the front-to-rear direction. Each of the tail portions 313 is bent at an angle relative to the corresponding flat contact portion 311; for example, the tail portion 313 may be vertical to the flat contact portion 311. In one embodiment, as shown in FIG. 3*a*, several second receptacle terminals 30 may be arranged and fixed by a positioning member 39. In another embodiment, as shown in FIG. 3*b*, in the assembling, the shielding plate 20 is insert-molded with the second receptacle terminals 30 in advance to form a shielding module 22; next, the shielding module 22 is assembled with the terminal module 10, and the assembly of the terminal module 10 and the shielding module 22 are enclosed by the insulated housing 40 to form the inserting module 2.

After the first receptacle terminals 11, the mount member 13, the shielding plate 20, and the second receptacle terminals 30 are insert-molded with each other, the insulated housing 40 is formed out of the assembly of the first receptacle terminals 11, the mount member 13, the shielding plate 20, and the second receptacle terminals 30 to enclose the assembly. The insulated housing 40 comprises a tongue portion 41 extending therefrom. The flat contact portions 111 and the flat contact portions 311 are respectively held in a lower surface and an upper surface of the tongue portion 41. Moreover, front ends of the flat contact portions 111, 311 are held in and positioned with the front portion 411 of the tongue portion 41. After the assembling and molding procedure, the tail portions 113 are protruding from the mount member 13, and the tail portions 313 are protruding from the insulated housing 40. In addition, the shielding plate 20 is on the tongue portion 41, and two sides of the shielding plate 20 are exposed from two lateral surfaces of the tongue portion 41.

Figure 5:
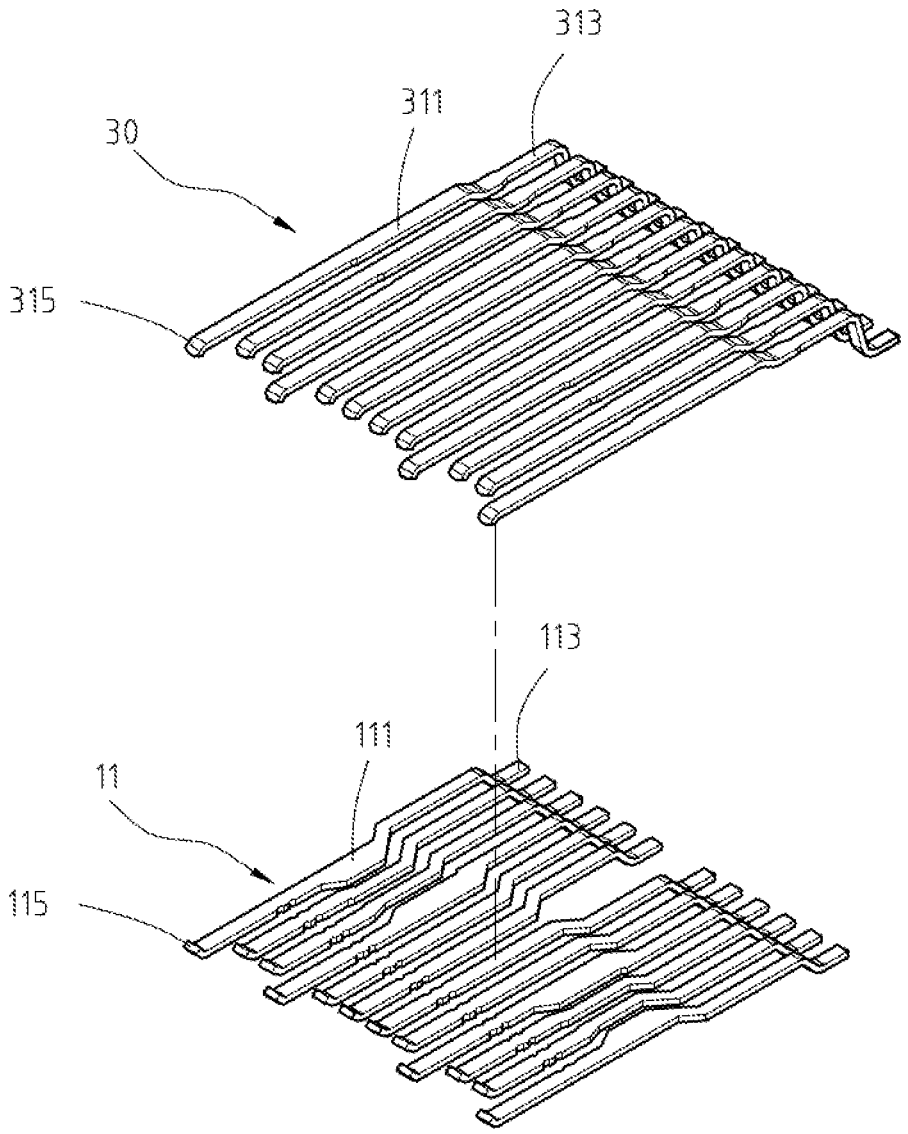
FIG. 5 illustrates a perspective view of another embodiment of receptacle terminals of the electrical receptacle connector.
Figure 6:
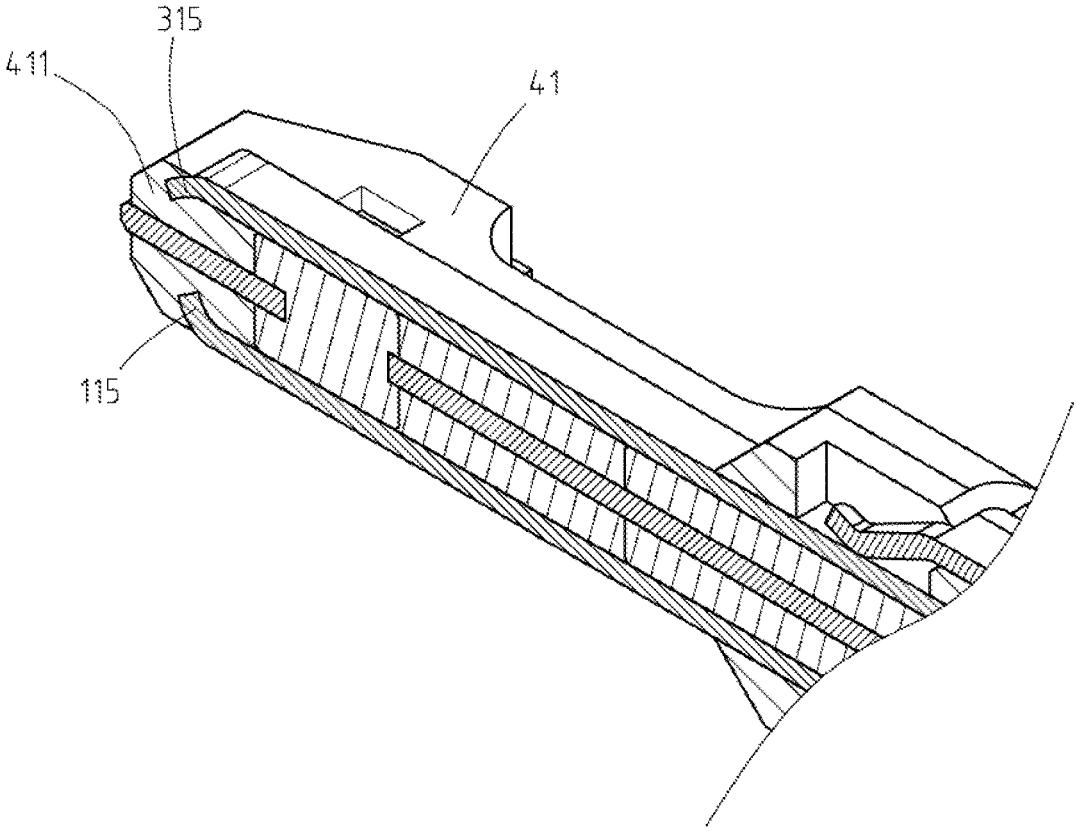
FIG. 6 illustrates a partial sectional view of another embodiment of the electrical receptacle connector.

Furthermore, as shown in FIG. 3*a*, in addition to the flat portion 21, the shielding plate 20 further comprises an end portion 25 extending from the flat portion 21. The end portion 25 is bent at an angle relative to the flat portion 21; for example, the end portion 25 may be vertical to the flat portion 21. The end portion 25 partially shields the tail portions 113 of the first receptacle terminals 11 from the tail portions 313 of the second receptacle terminals 30. The end portion 25 is engaged with the mount member 13 so as to improve the electromagnetic shielding. Please refer to FIGS. 5 and 6. FIG. 5 illustrates a perspective view of another embodiment of receptacle terminals of the electrical receptacle connector. FIG. 6 illustrates a partial sectional view of another embodiment of the electrical receptacle connector. As shown in FIGS. 5 and 6, in this embodiment, the front end of each of the flat contact portions 111 further comprises a first engaging portion 115 warping upward, and the front end of each of the flat contact portions 311 further comprises a second engaging portion 315 warping downward. After the insert-molding procedures, the fist engaging portions 115 and the second engaging portions 315 are held in the front portion 411 of the tongue portion 41. Accordingly, the first receptacle terminals 11 and the second receptacle terminals 30 can be firmly positioned in the tongue portion 41.

Figure 7:
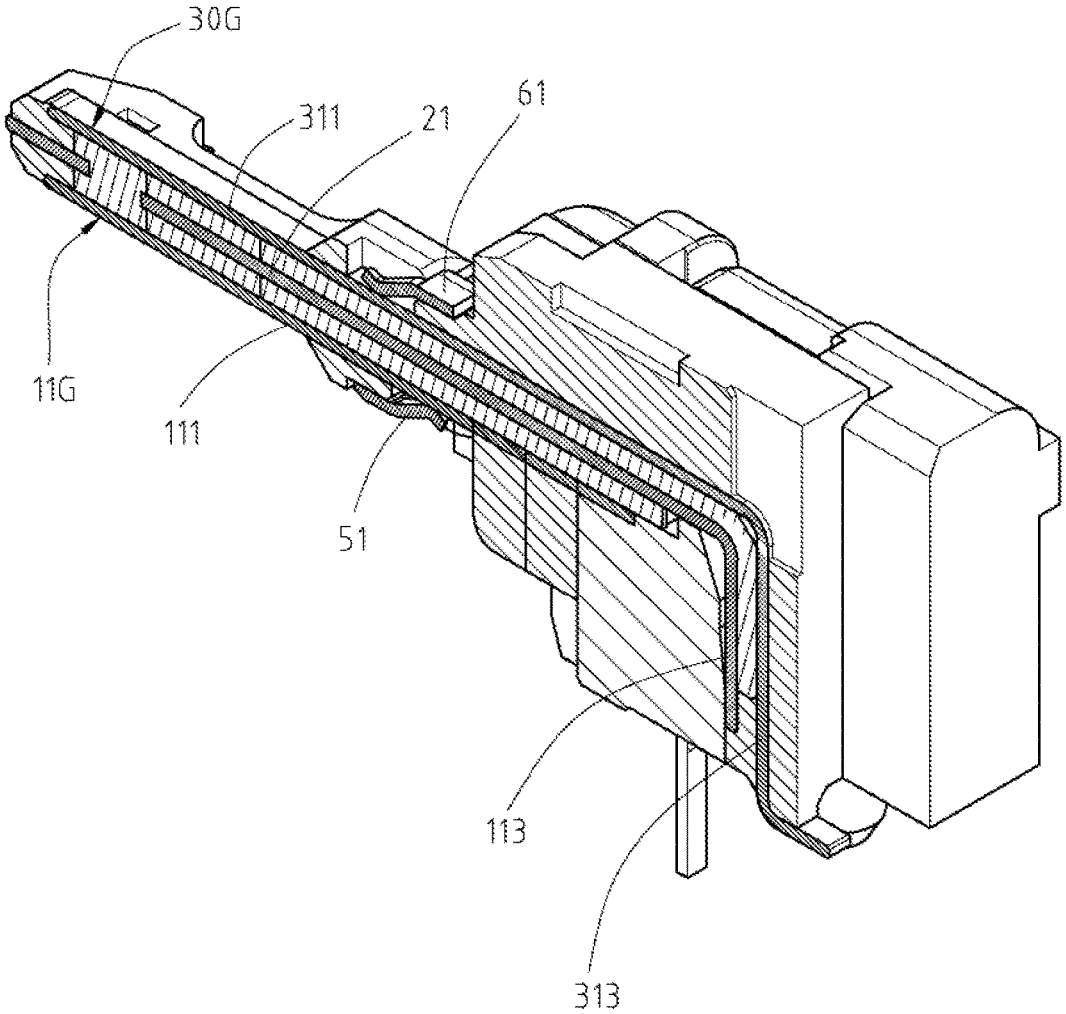
FIG. 7 illustrates another partial sectional view of the electrical receptacle connector.
Figure 8:
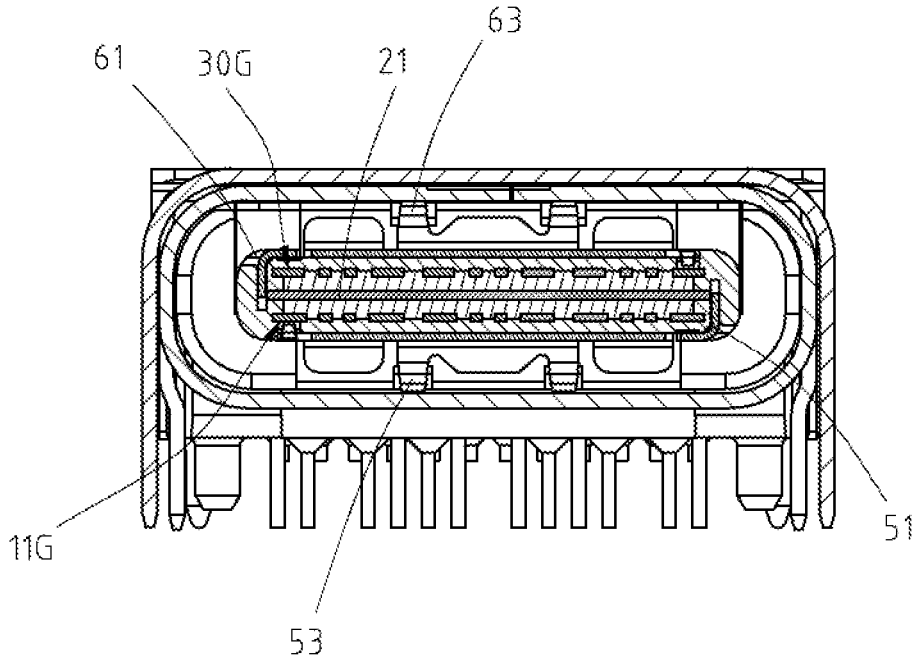
FIG. 8 illustrates a front view of the electrical receptacle connector.
Figure 9:
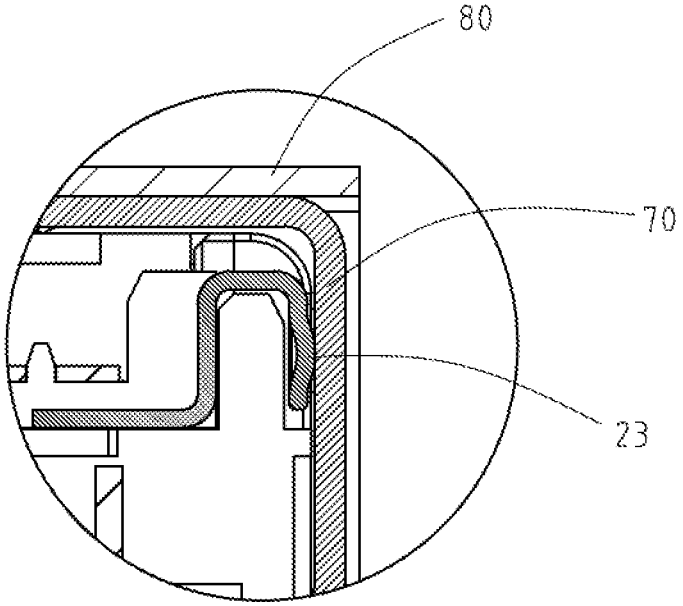
FIG. 9 illustrates yet another partial sectional view of the electrical receptacle connector.

Please refer to FIGS. 7 to 10. FIG. 7 illustrates another partial sectional view of the electrical receptacle connector. FIG. 8 illustrates a front view of the electrical receptacle connector. FIG. 9 illustrates yet another partial sectional view of the electrical receptacle connector. FIG. 10 illustrates a schematic configuration diagram of the receptacle terminals of the electrical receptacle connector. As shown in FIGS. 7 to 10 as well as FIG. 2, the electrical receptacle connector 1 further comprises a first conductive sheet 50 and a second conductive sheet 60. The first conductive sheet 50 and the second conductive sheet 60 are above and below the insulated housing 40, respectively, for shielding the first receptacle terminals 11 from the second receptacle terminals 30.

As shown in FIGS. 2 and 7, the first conductive sheet 50 has two first contact legs 51 at two sides thereof. The two first contact legs 51 pass through two first through holes 43 of the insulated housing 40 and are in contact with two ground terminals 11G which are at two sides of the first receptacle terminals 11, respectively. Conversely, the second conductive sheet 60 has two second contact legs 61 at two sides thereof. The two second contact legs 61 passes through two second through holes 45 of the insulated housing 40 and are in contact with two ground terminals 30G which are at two sides of the second receptacle terminals 30. Accordingly, a ground circuit is established.

As shown in FIG. 2 and FIGS. 8 and 9, the electrical receptacle connector 1 further comprises an inner shell 70 for preventing from electromagnetic radiations. The inner shell 70 encloses the insulated housing 40, and the inner shell 70 is in contact with a first contact block 53 of the first conductive sheet 50 and the second contact block 63 of the second conductive sheet 60. Moreover, the electrical receptacle connector 1 further comprises an outer shell 80 assembled to the outside of the inner shell 70.

Furthermore, the connecting members 23 at two sides of the shielding plate 20 are between the mount member 13 and the insulated housing 40. For example, the connecting members 23 are respectively disposed on the holding portions 133. During the insert-molding procedures, the insulated housing 40 is formed on the supporting portion 131 and the holding portions 133, so that the connecting members 23 can be fixed. The connecting members 23 are extending from two sides of the mount member 13 and in contact with the inner shell 70 to form a grounding circuit.

Please refer to FIGS. 8 to 10. The two sides of the first receptacle terminals are ground terminal, and the two sides of the second receptacle terminals are ground terminals.

In addition, the first receptacle terminals further comprise first signal terminals and power terminals. for example, as shown in FIGS. 8 and 10, the second receptacle terminals comprise, from left to right, a ground terminal (GND), a first differential signal pairs (TX1+−), a power terminal (VBUS), a function detection terminal (CC1), a second differential signal pairs (D+−), a supplement terminal (SBU1), another power terminal (VBUS), a third differential signal pairs (RX2−+), and another ground terminal (GND). Likewise, the first receptacle terminals comprise, from right to left, a ground terminal (GND), a first differential signal pairs (TX2+−), a power terminal (VBUS), a function detection terminal (CC2), a second differential signal pairs (D+−), a supplement terminal (SBU2), another power terminal (VBUS), a third differential signal pairs (RX1−+), and another ground terminal (GND). Therefore, twelve first receptacle terminals and twelve second receptacle terminals are conformed to transmit USB 2.0 and 3.0 signals. Pin-assignments of the first receptacle terminals 11 and the second receptacle terminals 30 are point-symmetrical with a central point of the inner shell 70 as the symmetrical center. In other words, pin-assignments of the first receptacle terminals 11 and the second receptacle terminals 30 have 180-degree symmetrical design with respect to the central point of a receptacle cavity defined by the inner shell 70 as the symmetrical center.

Furthermore, the specification for transmitting the first signals is conformed to the specification for transmitting the second signals. The dual or double orientation design enables an electrical plug connector to be inserted into the electrical receptacle connector 1 in either of two intuitive orientations, i.e., in either upside-up or upside-down directions.

Accordingly, the front portions of the terminals are fixed during the terminals are insert-molded with the insulated housing. Therefore, during the connector is mated with a mating connector, the terminals can be firmly positioned on the tongue portion to prevent from being damaged by the mating connector. Furthermore, the terminals can be designed in a simple way without several bending portions. Moreover, the shielding plate can be provided for establishing a grounding circuit, improving the shielding effect. Therefore, the efficacy of the connector in high frequency signal transmission can be improved.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a mount member comprising a supporting portion and two holding portions at two sides of the supporting portion;

a plurality of first receptacle terminals integrally formed on the mount member, wherein each of the first receptacle terminals comprises a first flat contact portion, a first body portion, and a first tail portion, the first body portions are held in the mount member, and each of the first flat contact portions is extending forward from the corresponding first body portion in the rear-to-front direction and protruding from the mount member;

an insulated housing molded with the mount member, the first receptacle terminals, and a plurality of second receptacle terminals to form a tongue portion, wherein each of the second receptacle terminals comprises a second flat contact portion, a second body portion, and a second tail portion, each of the second flat contact portions is extending forward from the corresponding second body portion in the rear-to-front direction, the second flat contact portions are on an upper surface of the tongue portion, and front ends of the second flat contact portions are held in the tongue portion, the second tail portions are protruding from the insulated housing, the first flat contact portions are on a lower surface of the tongue portion which is opposite to the upper surface, and front ends of the first flat contact portions are held in the tongue portion; and a shielding plate on the tongue portion and between the first receptacle terminals and the second receptacle terminals, wherein the shielding plate has two connecting members at two sides, the shielding plate is engaged onto the holding portions and positioned with the mount member, and the connecting members are on the respective holding portions, wherein each of the connecting members has a receiving cavity facing downwardly for engaging with the corresponding holding portion of the mount member.

2. The electrical receptacle connector according to claim 1, further comprising a first conductive sheet and a second conductive sheet, wherein the first conductive sheet and the second conductive sheet are above and below the insulated housing, respectively.

3. The electrical receptacle connector according to claim 2, wherein the first conductive sheet has two first contact legs at two sides thereof, the two first contact legs pass through two first through holes of the insulated housing and are in contact with two first ground terminals which are at two sides of the first receptacle terminals, respectively.

4. The electrical receptacle connector according to claim 3, wherein the second conductive sheet has two second contact legs at two sides thereof, the two second contact legs pass through two second through holes of the insulated housing and are in contact with two second ground terminals which are at two sides of the second receptacle terminals, respectively.

5. The electrical receptacle connector according to claim 2, further comprising an inner shell assembled to the outside of the insulated housing and the mount member, wherein the inner shell is in contact with the first conductive sheet and the second conductive sheet.

6. The electrical receptacle connector according to claim 5, wherein the two connecting members are extending from two sides of the mount member and in contact with the inner shell, and the two connecting members are between the mount member and the insulated housing.

7. The electrical receptacle connector according to claim 5, further comprising an outer shell assembled to the outside of the inner shell.

8. The electrical receptacle connector according to claim 1, wherein the insulated housing is assembled with the supporting portion and the holding portions, and the tongue portion is positioned between the holding portions.

9. The electrical receptacle connector according to claim 1, wherein the mount member and the first receptacle terminals are pre-molded to form a terminal module.

10. The electrical receptacle connector according to claim 9, wherein the shielding plate and the second receptacle terminals are pre-molded, assembled with the terminal module, and enclosed by the insulated housing.

11. The electrical receptacle connector according to claim 1, wherein an upper surface and a lower surface of the shielding plate are processed with an insulating treatment, the shielding plate is above the mount member and the first receptacle terminals and below the second receptacle terminals.

12. The electrical receptacle connector according to claim 1, wherein the mount member has two positioning grooves concaved from the holding portions, and the two connecting members are positioned at the positioning grooves.

13. The electrical receptacle connector according to claim 12, wherein two ends of each of the connecting members are abutted against two outer peripheries of the corresponding positioning groove, respectively.

14. An electrical receptacle connector, comprising:

a mount member comprising a supporting portion and two holding portions at two sides of the supporting portion;

a plurality of first receptacle terminals integrally formed on the mount member, wherein each of the first receptacle terminals comprises a first flat contact portion, a first body portion, and a first tail portion, the first body portions are held in the mount member, and each of the first flat contact portions is extending forward from the corresponding first body portion in the rear-to-front direction and protruding from the mount member;

an insulated housing molded with the mount member, the first receptacle terminals, and a plurality of second receptacle terminals to form a tongue portion, wherein each of the second receptacle terminals comprises a second flat contact portion, a second body portion, and a second tail portion, each of the second flat contact portions is extending forward from the corresponding second body portion in the rear-to-front direction, the second flat contact portions are on an upper surface of the tongue portion, and front ends of the second flat contact portions are held in the tongue portion, the second tail portions are protruding from the insulated housing, the first flat contact portions are on a lower surface of the tongue portion which is opposite to the upper surface, and front ends of the first flat contact portions are held in the tongue portion; and a shielding plate on the tongue portion and between the first receptacle terminals and the second receptacle terminals, wherein the shielding plate has two connecting members at two sides, the shielding plate is engaged onto the holding portions and positioned with the mount member, and the connecting members are on the respective holding portions, wherein an upper surface and a lower surface of the shielding plate are processed with an insulating treatment, the shielding plate is above the mount member and the first receptacle terminals and below the second receptacle terminals, and wherein the upper surface and the lower surface of the shielding plate comprise a plurality of protruding ribs, the protruding ribs respectively form a plurality of channels on the upper surface and the lower surface of the shielding plate, the first receptacle terminals and the second receptacle terminals are respectively positioned in the channels on the upper surface and the lower surface of the shielding plate.

15. The electrical receptacle connector according to claim 1, wherein the shielding plate comprises a flat portion and an end portion extending from the flat portion, the end portion partially shields the first tail portions from the second tail portions.

16. The electrical receptacle connector according to claim 1, wherein each of the first tail portions is bent at an angle relative to the corresponding first flat contact portion.

17. The electrical receptacle connector according to claim 1, wherein each of the second tail portions is bent at an angle relative to the corresponding second flat contact portion.

18. The electrical receptacle connector according to claim 1, wherein the front end of each of the first flat contact portions comprises a first engaging portion held in the tongue portion.

19. The electrical receptacle connector according to claim 1, wherein the front end of each of the second flat contact portions comprises a second engaging portion held in the tongue portion.

20. An electrical receptacle connector, comprising:

a mount member integrally formed with a plurality of first receptacle terminals, wherein each of the first receptacle terminals comprises a first flat contact portion, a first body portion, and a first tail portion, the first body portions are held in the mount member, the mount member comprises a supporting portion and two holding portions at two sides of the supporting portion, and each of the first flat contact portions is extending forward from the corresponding first body portion in the rear-to-front direction and protruding from the mount member;

a shielding plate on the mount member and above the first receptacle terminals, wherein the shielding plate has two connecting members at two sides, the shielding plate is engaged onto the holding portions and positioned with the mount member, and the connecting members are on the respective holding portions, wherein each of the connecting members has a receiving cavity facing downwardly for engaging with the corresponding holding portion of the mount member;

a plurality of second receptacle terminals above the shielding plate, so the shielding plate is between the first receptacle terminals and the second receptacle terminals, wherein each of the second receptacle terminals comprises a second flat contact portion, a second body portion, and a second tail portion, each of the second flat contact portions is extending forward from the corresponding second body portion in the rear-to-front direction; and an insulated housing comprising a base portion and a tongue portion extending from one end of the base portion, wherein the base portion and the mount member are pre-molded, and the tongue portion is integrally formed with and covering the first receptacle terminals, the shielding plate, and the second receptacle terminals, the first flat contact portions are on a lower surface of the tongue portion, and front ends of the first flat contact portions are held in the tongue portion, the second flat contact portions are on an upper surface of the tongue portion which is opposite to the lower surface, and front ends of the second flat contact portions are held in the tongue portion.

21. The electrical receptacle connector according to claim 20, wherein the mount member has two positioning grooves concaved from the holding portions, and the two connecting members are positioned at the positioning grooves, and two ends of each of the connecting members are abutted against two outer peripheries of the corresponding positioning groove, respectively.

* * * * *